United States Patent [19]

Touze

[11] 4,411,311

[45] Oct. 25, 1983

[54] HEAT EXCHANGE DEVICES FOR COOLING THE WALL AND REFRACTORY OF A BLAST-FURNACE

[76] Inventor: Francois Touze, Chateau de Logne, 57310 Guenange, France

[21] Appl. No.: 249,843

[22] Filed: Apr. 1, 1981

Related U.S. Application Data

[60] Continuation-in-part of Ser. No. 120,912, Feb. 12, 1980, abandoned, which is a division of Ser. No. 906,210, May 15, 1978, Pat. No. 4,210,101.

[30] Foreign Application Priority Data

May 25, 1977 [FR] France ..... 77 15939
Apr. 2, 1980 [FR] France ..... 80 07506

[51] Int. Cl.[3] ..... F28F 3/14

[52] U.S. Cl. ..... 165/170; 373/74; 373/76; 122/6 B

[58] Field of Search ..... 165/170, 142, 168, 169; 122/6 B; 432/233, 238; 373/74, 76; 266/190

[56] References Cited

U.S. PATENT DOCUMENTS

| | | | |
|---|---|---|---|
| 840,195 | 1/1907 | Berry | 122/6 B |
| 941,215 | 11/1909 | Wade | 165/170 |
| 1,012,895 | 12/1911 | Muirhead | 165/170 |
| 1,031,389 | 7/1912 | Smith | 122/6 B |
| 1,434,849 | 11/1922 | Smith | 122/6 B |
| 1,749,395 | 10/1927 | Rice | 122/6 B |
| 1,830,318 | 11/1927 | Harlan | 122/6 B |
| 2,252,606 | 5/1941 | Wick | 122/6 B |
| 3,144,854 | 8/1964 | Smith | 165/156 |
| 4,314,695 | 2/1982 | Widmer | 122/6 B |

*Primary Examiner*—Albert W. Davis, Jr.
*Assistant Examiner*—S. Gayle Dotson
*Attorney, Agent, or Firm*—Larson and Taylor

[57] ABSTRACT

The invention relates to heat exchange devices for cooling the wall and the refractory of a blast-furnace. Such a device comprises a body shaped substantially as a body of revolution and having first and second end walls and a curved wall extending therebetween, the first end wall being a heat-transfer wall, a supply port and a discharge port for heat-transfer fluid, the ports being spaced-apart radially, the supply port being adapted for tangentially supplying the heat-transfer fluid into the body and the discharge port being adapted for tangentially discharging the heat-transfer fluid from the body, so that, in use, the fluid flows between the ports in a spiral path over the inner surface of the first end wall, the body having no internal obstacle to such flow. (FIG. 1)

17 Claims, 12 Drawing Figures

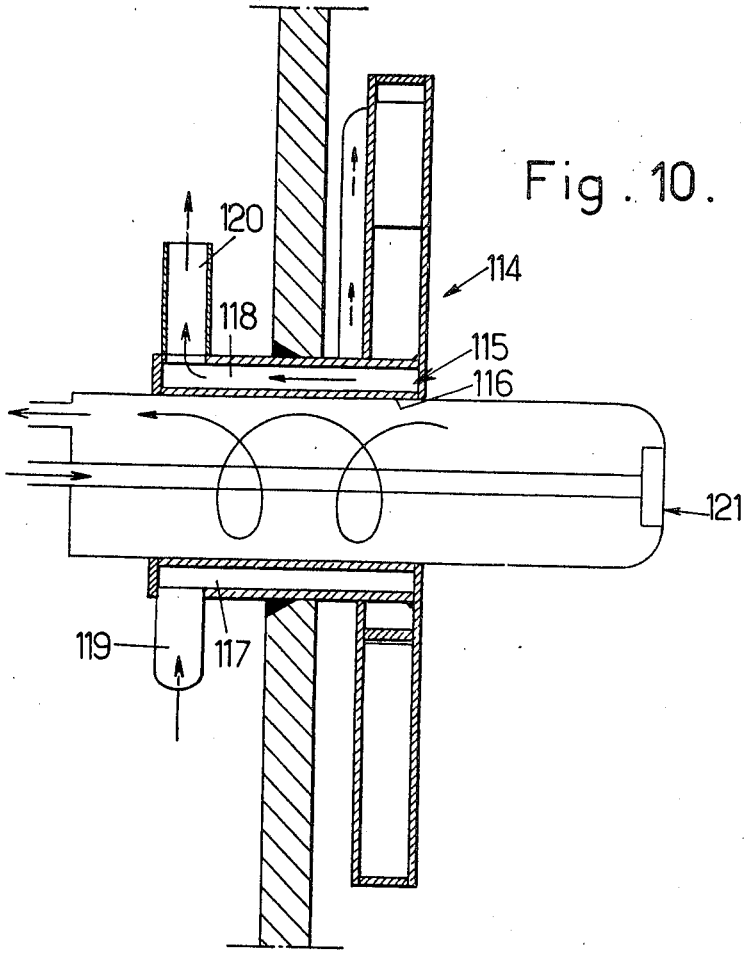
Fig. 10.
Fig.11.
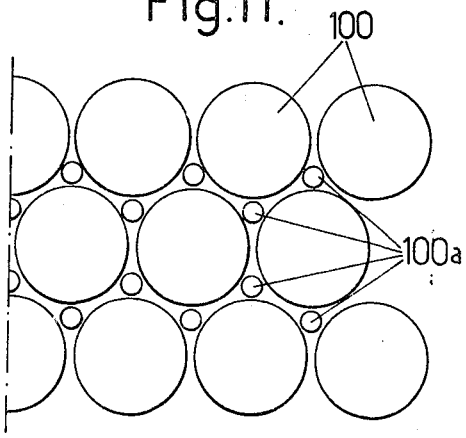
Fig.12.
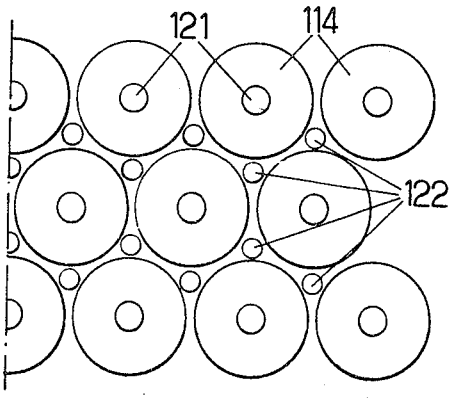

HEAT EXCHANGE DEVICES FOR COOLING THE WALL AND REFRACTORY OF A BLAST-FURNACE

This application is a continuation-in-part of Ser. No. 120,912, filed Feb. 12, 1980, now abandoned, which is a division of Ser. No. 906,210, filed May 15, 1978, now U.S. Pat. No. 4,210,101.

The present invention relates to improvements applicable to heat exchangers used for cooling the wall of a blast-furnace and comprising a closed enclosure provided with a generally flat shape (i.e. the thickness is small versus the diameter) and substantially of revolution about a revolution axis, a cooling liquid being circulated in said enclosure, said improvements being added to those applicable to said devices as described in the main patent application.

It will be firstly reminded that heat exchangers of the above-mentioned type (currently named as "cooling plates" in the art) are disposable, in the most exposed parts of the blast-furnace, between the metal casing of the blast-furnace and the inner refractory wall so as the metal casing is not too heated. Other heat exchangers of the above-mentioned type (currently named "flat cooling boxes" or "flat boxes" in the art) are disposable, like usual cooling boxes, substantially perpendicularly to the blast-furnace wall and extend into the refractory that they mechanically support and that they cool so that the refractory is not too fastly damaged under the action of heat.

One object of the invention is to provide heat exchanges while only using a minimum quantity of cooling liquid per unity of time.

Another object of the invention is to provide such heat exchanges so that the cooling liquid removes, from the wall of the enclosure, a maximum quantity of heat per unity of time.

Another object of the invention is to minimise the pressure losses during circulation of the liquid in the enclosure.

Another object of the invention is to provide a heat exchange device which only needs for its manufacture a minimum quantity of material, so that, even if recourse is had to an expensive material, such as copper, the cost of the device remains low.

Finally another object of the invention is to obtain the highest water speed possible on the parts to be the most intensely cooled, owing to which the heat exchanges at these parts are the highest.

According to the invention, there is provided a heat exchanger comprising a body shaped substantially as a body of revolution and having first and second end walls and a curved wall extending therebetween, the first end wall being a heat transfer wall, a supply port and a discharge port for heat transfer fluid, the ports being spaced apart radially, the supply port being adapted for tangentially supplying the heat transfer fluid into the body and the discharge port being adapted for tangentially discharging the heat-transfer for fluid from the body so that, in use, the fluid flows between the ports in a spiral path over the inner surface of the first end wall, the body having no internal obstacle to such flow.

It is advantageous for the supply port and the discharge port to be respectively adjacent the periphery and the centre of the first end wall.

Some particular arrangements may be applicable to these cooling devices so as to make them suitable for special applications.

For this, in a first embodiment, it is envisaged that, with the means for tangential injection of the liquid opening tangentially into the enclosure at the periphery or in the vicinity of the periphery thereof and with the means for tangential discharge of liquid situated in the center of the enclosure, the tangential discharge means comprise at least one assembly of deflecting means situated in the center of the enclosure and a duct opening into a face of the enclosure opposite said deflecting means.

Because of the presence of the deflecting means, recovery of the cooling liquid is facilitated in its spiral rotating movement and its delivery at the port of the discharge duct. This recovery is effected more rapidly, which further improves the flow of the liquid and allows more efficient cooling of the walls of the enclosure to be achieved.

The discharge duct may extend radially from the center of the enclosure towards the periphery of the enclosure.

So as not to increase the thickness of the heat exchange device, it is advantageous for the radial discharge duct to be inside the enclosure, for it to extend substantially at the same distance from the two lateral walls of the enclosure and for it to be provided with two assemblies of deflecting means situated on each side of said duct. Preferably, the radial discharge duct is then shaped outwardly so as to offer minimum resistance to the liquid rotating in the enclosure.

Advantageously, the radial discharge duct opens into a transit chamber, outside the enclosure and comprising a water outlet orifice.

Another arrangement, to which recourse is had either in combination with one or other of the preceding ones, consists in the tangential discharge means comprising a duct opening tangentially into the enclosure, at the periphery thereof, the port of said duct being diametrically opposite the port of the tangential injection means.

In another embodiment according to the invention, it is envisaged that, with the tangential injection means opening into the central part of the enclosure and with the tangential discharge means situated at the periphery of the enclosure, the tangential injection means comprise at least one liquid supply duct opening into at least one face of the enclosure and substantially in the center of said face and at least one assembly of deflecting means situated opposite the port of said duct, so as to impart a tangential force component to the liquid emerging into the enclosure.

The flat cooling boxes used up to now have a general flattened substantially parallelepipedic shape whose rear part is provided with means for fixing to the plating and whose front part (or nose) is formed by a flat face which is fitted with a small radius to the lateral faces.

So as to cause the cooling liquid to flow in the nose, there is provided inside the enclosure thus formed at least one separating wall forcing the liquid to follow the outer wall of the box.

However, in the 90° bends, the speed of the streams of liquid—which are situated outermost (i.e. in contact with the wall of the box)—is greatly reduced; the result is that this bend zone is poorly cooled whereas the nose is precisely the part of the box which is the most exposed to the heat.

Furthermore, this reduction is the speed of the liquid may be such that recirculation, or dead water zone, is created in the bend promoting decantation of solid particles which slow down the heat exchange. The wall of the enclosure heats up, which further increases scaling, which slows down even further the heat exchanges.

This cumulative phenomenon spreads by degrees and the box finishes by being destroyed under the action of thermomechanical abrasion, for poorly cooled copper (from which these boxes are generally made) loses all its mechanical characteristics and is very easily worn, not only by the charges but also by hot gases, dust charges, etc.

As far as the streams of liquid which are situated innermost in the bend (in contact with the internal separating wall) are concerned, their speed is greatly increased, which may lead to very high speeds of the liquid if the flow has been increased to improve cooling of the plate.

The effects of this high flow rate of the liquid are even more harmful than in the preceding case for, in this region where the liquid undergoes a 180° change of path, there occurs cavitation causing a pressure drop and rapid wear of the separating wall.

Furthermore, the increase in the speed of the cooling liquid can only be obtained practically by reducing the section of the ducts, which leads to a reduction of the volume of liquid and so of the thermal fly-wheel.

Finally, these boxes are difficult to construct and so costly.

Implementation of the arrangements in accordance with the invention for constructing a flat cooling box allows an enclosure to be obtained which comprises no bend having a small radius of curvature and in which the streams of liquid follow paths whose radii are sufficiently great to avoid creation of the above-mentioned dead zones; furthermore, there exists no part likely to cause a cavitation phenomenon. Deposits of solid particles are then avoided and no region of the box is subjected to particular destructive wear.

Moreover, it will be noted that the whole of the cooling liquid mass is set in rotation inside the enclosure and that the whole of this mass participates at all times in cooling the walls. The result is a considerably increased cooling efficiency with respect to what was obtained up to now.

Finally, the manufacture of flat boxes thus constructed is very simple and so less expensive than that of known flat boxes.

In a preferred embodiment, there is provided, for supply and discharge of the cooling liquid, connection means disposed side by side and connected to the enclosure by ducts which extend between two planes containing the two substantially parallel faces of the enclosure.

Finally, a complementary arrangement, more particularly advantageous in the case where the heat exchange device is intended to be used as a cooling box, consists in providing a second enclosure covering at least the front part of the first enclosure, no communication for the cooling liquid existing between the first and second enclosures.

The addition of this second enclosure increases considerably the efficiency of the heat exchange device of the invention for a bulk which is in general scarcely greater.

Moreover, by causing the cooling liquid to flow in opposite directions in the two enclosures, better distributed and more even cooling is obtained over the whole of the periphery of the device since there corresponds, to one region of an enclosure through which flows heated liquid, a region of the other enclosure through which still cold liquid flows.

The arrangements of the invention find a second application in the so-called "vaporization" cooling boxes in which there is formed vapor bubbles on contact with hot walls.

This type of box is arranged so that the vapor bubbles are collected, by gravity, in the discharge duct for the cooling liquid.

The major disadvantage of the vaporization boxes used at present is that the heat is removed essentially by convection. In the case of harsh heat aggression in a given zone of the box, this heat flow may be all the less efficiently removed since in general no pump is provided in the circuit and since the flow of the cooling liquid takes place naturally by a thermosiphon phenomenon. The result is a calefaction phenomenon in the zone considered, causing in the ducts formation of a vapor plug which interrupts, and may even sometimes reverse, the natural flow of the cooling liquid. Uncooled, the box is rapidly destroyed.

On the contrary, in a cooling box constructed in accordance with the invention, the vapor bubbles are subjected to the action of the centrifugal force due to the rotation of the liquid mass. Thus, because of the existence of this gravitational field, the vapor bubbles are torn from the wall as fast as they are created and are carried towards the center of the box.

For a cooling box formed in accordance with the preceding arrangements, it is provided for the radial duct, extending from the central zone of the box to the rear thereof, to be situated in the upper part of the box (in the mounted position thereof), and preferably outside the enclosure, so as to form a chamber for recovering the water-vapor emulsion which is then discharged.

The arrangements of the invention find a third application in cooling plates.

The cooling plates used at present are in the form of rectangular metal plates through which pass a plurality of ducts intended for circulation of the cooling liquid. The ducts are independent of each other and each has an inlet port and an outlet port provided respectively with securing means for connection to outside hydraulic circuits. Furthermore, these plates comprise securing means for the fixing thereof to the plating of the blast-furnace.

Typically, a known cooling plate comprises at least twelve securing points, either for fixing them or for connecting them to outside circuits.

The very high temperatures to which the plates are exposed cause expansions which are incompatible with such a high number of rigid points and the plates are subjected to mechanical stresses such that they are rapidly made unusable.

Furthermore, the cooling liquid flow rate in these known plates is too low and the thermal fly-wheel thus created is too small to provide efficient cooling of the plating.

On the contrary, by its very design, the cooling device of the invention, because of the relatively high volume of liquid set in rotation, has a high thermal fly-wheel which allows much better cooling than that obtained up to present.

As for the problem of mechanical stresses, it is resolved in the cooling device of the invention by the fact that:

the two pipes for supplying and discharging the cooling liquid extent approximately perpendicularly to that one of the walls of the device which, in the mounted position in the blast-furnace, is in contact with the plating of said blast-furnace, from the central region of said wall, the two ducts are concentric, at least in the vicinity of said wall, and the means for fixing the plate to the plating of the furnace comprise that one of said ducts which is outside the other and an orifice, pierced in the plating, adapted to receive said outer duct, securing means being used for securing this outer duct to the edge of the orifice or to the zone of the plating surrounding the orifice.

Thus, with these arrangements, the cooling plate is only secured to the plating in a single zone, which removes any problem of mechanical stresses due to expansion during operation.

Moreover, still because of the simple structure of the cooling devices in accordance with the invention, cooling plates thus formed are simple to manufacture, so less expensive, than the plates known at present.

A variation of the plate which has just been described consists in providing it with an axial cavity open at both ends, the enclosure surrounding the cavity and the supply and discharge ducts surrounding at least partially the cavity, the transverse dimensions of the cavity being sufficient for it to be possible to introduce therein an elongate and cylindrical cooling device.

It may thus be seen that a combined cooling device, associating a cooling plate and a cooling box, which ensures a particularly favourable result since, for a bulk which is that of the cooling plate, deep cooling is effected within the refractory material, on the one hand, and a thermal screen is formed protecting the plating, on the other.

Embodiments of the invention will now be described by way of example. In this description, reference is made to the accompanying drawings in which:

FIG. 10 shows a further variation of the cooling plate of FIGS. 8 and 9; and FIGS. 11 and 12 show respectively two possible arrangements of cooling plates and boxes in accordance with the invention.

Figure 2:
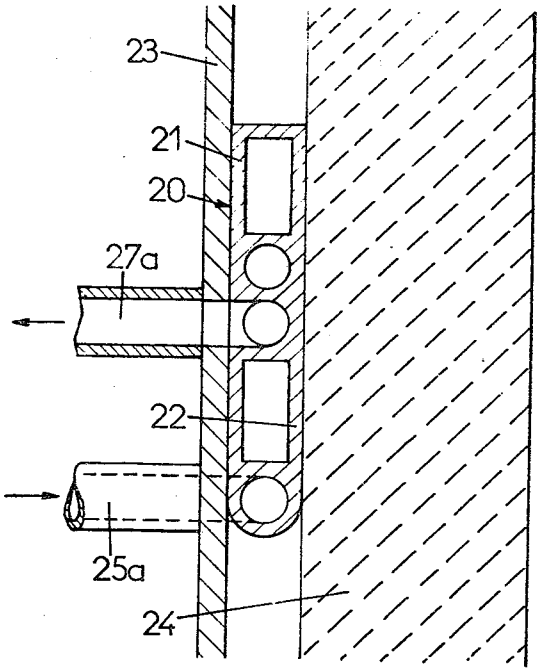
FIG. 2 is a section along line II—II of FIG. 1 and shows also a portion of a blast-furnace.
Figure 1:
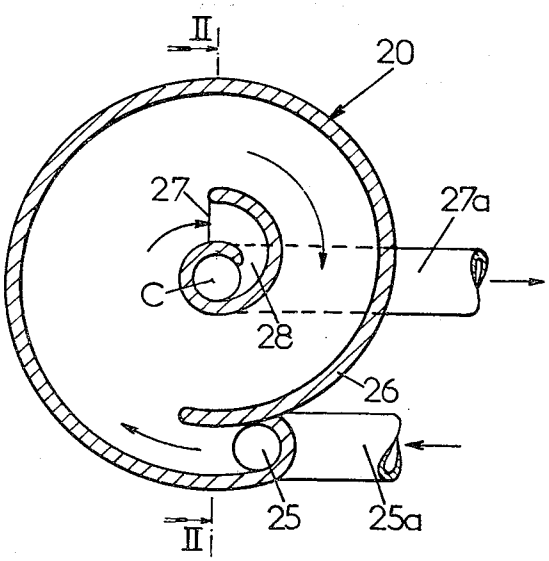
FIG. 1 is a vertical sectional view of a cooling plate.

Referring to FIGS. 1 and 2, a cooling box has a flattened shape and in the art is called a "cooling plate". This terminology will be adopted in the continuation of the description.

Such plates are not disposed in the refractory like elongate cylindrical boxes, but between the refractory and the internal face of the plating so as to form a continuous or discontinuous thermal screen, depending on the gap left between two consecutive plates, between the heat source and the plating.

These plates are, like the elongate boxes, made from a heating conducting and mechanically resistant material, such as steel, cast iron or copper.

Referring to FIGS. 1 and 2 in which is shown a plate 20, this plate 20 has a flattened shape, its parallel faces 21 and 22 being respectively in contact with plating 23 and the refractory 24 of a blast-furnace, and it is hollow to allow cooling to flow.

Faces 21 and 22 are round. An injection port 25 opens into plate 20 tangentially to a substantially cylindrical sidewall 26.

A discharge port 27 opens tangentially adjacent the center of plate 20 and a discharge pipe 28 coils towards the center of the plate and is bent so as to leave the plate through the face 21 in the center thereof. Liquid inlet **25*a* and discharge 27*a*** pipes are disposed substantially perpendicularly to the plate.

Plate 20 has the general aspect of a snail shell.

It will be noted that the axes of the injection 25 and discharge 27 ports are respectively at distances R and r from the center C of box 20. For this reason, so that the inlet and outlet flows of liquid may be equal, it is necessary to section S of the discharge port to be greater than section s of the injection port.

The equality of flows produces as a consequence:

$$V_1 \cdot s = V_2 \cdot S$$

$V_1$ and $V_2$ designating the inlet and outlet speeds which are in the ratio of distances R and r, i.e.

$$V_1/R = V_2/r$$

The following geometrical condition must then be achieved:

$$R/r = S/s$$

It is necessary for the internal walls of plate 20 to present no roughness so as not to create turbulences within the mass of liquid in motion.

During operation, because of the tangential injection of liquid through port 25, the liquid mass is propelled with a rotational movement and evenly licks each point of walls 21, 22 of plate 20. It can be considered that the stream of liquid, introduced through port 25, coils round within the inner volume of the plate before reaching discharge port 27.

With the setting in rotation of the mass of cooling liquid, with the help of suitable deflector means, and by disposing the injection and discharge ports for the liquid in opposite regions of the device, it is ensured that each zone of walls 21, 22 to be cooled is licked by the liquid and is thus efficiently cooled.

By arranging for walls 21, 22 not to have any roughness and for nothing to oppose the rotational motion of the liquid mass, this latter is the seat of no turbulence and all the zones of walls 21, 22 to be cooled whichever they are and wherever they are located, are cooled in the same manner and with the same efficiency. Furthermore, pressure losses in a hydraulic circuit supplying plate 20 are practically eliminated.

It is thus possible to calculate very accurately the minimum flow of liquid to be injected into plate 20 so as to obtain a predetermined cooling and so as to achieve substantial economies on the amount of liquid necessary and, consequently, on the cost price of the cooling.

The flow of the liquid can also be accurately calculated so that it heats up to a high temperature, this heating up going possibly far enough to cause vaporization, which allows the efficiency of the device to be further increased due to the fact that the vapors, while escaping, help in the movement of the remaining liquid mass.

The geometrical shapes of the component parts of plate 20 are simplified. This reduces the amounts of material necessary and the manufacturing costs and so the overall cost price of the device. Thus, manufacturing of plate 20 from steel, cast iron or copper may be considered.

It is possible to mount several plates 20 or cylindrical cooling boxes in series by intercoupling them; thus there can be provided for example several intercoupled elongate cooling boxes, coupling between a cooling box and a cooling plate or intercoupling between several cooling plates.

Different particular embodiments of heat exchange devices of the flat type appropriate for certain particular applications will now be described.

Figure 3:
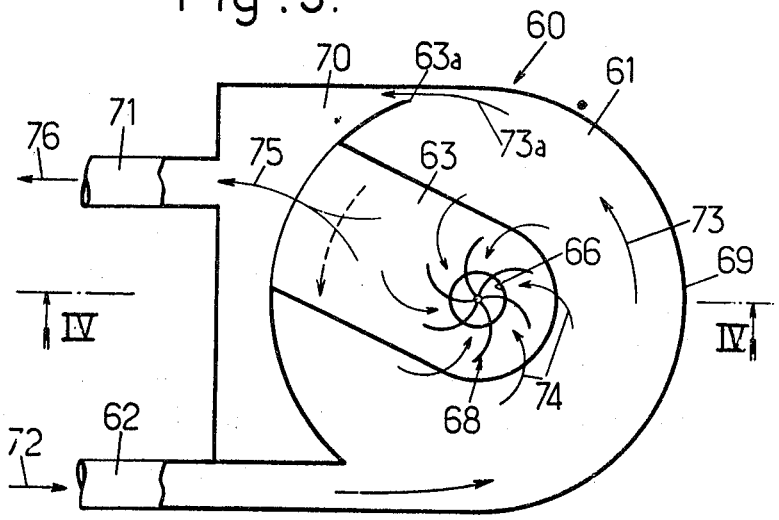
FIG. 3 represents schematically one embodiment of a heat exchange device constructed in accordance with the invention.
Figure 4:
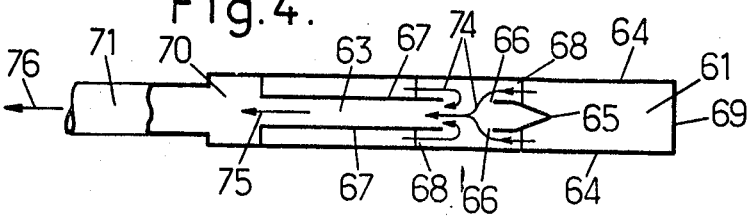
FIG. 4 is a sectional view along line IV—IV of FIG. 3.

Referring first of all to FIGS. 3 and 4 concerning a first embodiment, cooling box 60 comprises an enclosure 61 cylindrical in revolution having a flattened shape, i.e. its height is small in relation to its diameter.

A duct 62 for supplying cooling liquid opens tangentially into enclosure 61.

For discharging the liquid there is provided, on the one hand, an outlet 63, substantially diametrically opposite the port of supply pipe 72 and, on the other hand, a channel 63 extending radially approximately from the center to the periphery of enclosure 61; channel 63 is situated at the same distance from flat walls 64 of the enclosure and it is flattened and shaped, as can be seen at 65 in FIG. 4, so as to only disturb the liquid flow to a lesser degree.

Two holes 66, pierced respectively in the lateral faces thereof and centered at the center of the enclosure, allow the cooling liquid to pass from the enclosure into channel 63.

To facilitate this passage, there is furthermore provided, on each side of channel 63 (i.e. between each face 67 of the channel and each wall 64 of the enclosure), a deflecting device 68 formed from blades wound in the direction of the center of holes 66.

Channel 63 extends towards the rear of cooling plate 60, i.e. opposite the zone (or nose) 69 intended to be directed towards the region of the blast-furnace to be cooled when the box is installed in its operating position.

Channel 63 opens into a discharge chamber 70, contiguous with enclosure 61 and situated therebehind.

A duct 71 for discharging the cooling liquid opens into chamber 70, preferably opposite the port through which channel 63 opens into chamber 70 or opposite port 63*a*.

The cooling liquid (in general water), supplied by duct 62 (arrow 72) arrives in enclosure 61 in which, considering the form thereof, there is created a spiral movement (arrow 73). A part of the liquid of the external stream, which is in fact the most heated in contact with the wall of nose 69, passes directly through port 63*a* (arrow 73*a*) to be discharged. The rest of the mass of water, once in the vicinity of the central region of the enclosure, is recovered by the deflecting devices 68 (arrow 74) and penetrates into channel 63 from where it passes into chamber 70 (arrow 75) then leaves through duct 71 (arrow 76).

It will be noted that the whole of cooling box 60 is comprised between two parallel planes containing the faces 74 of the enclosure. The result is that box 60 may be easily introduced through the plating of the blast-furnace into its housing provided in the refractory material. Conversely, it may be easily removed therefrom, for example with a view to its replacement.

Figure 5:
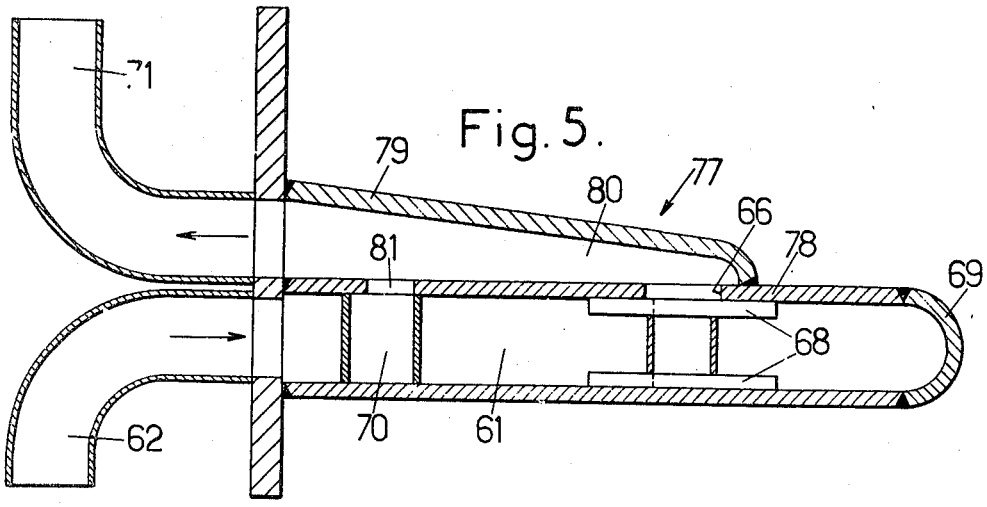
FIG. 5 represents schematically another embodiment of a heat exchange device in accordance with the invention.

FIG. 5 (in which the elements identical to those in FIGS. 3 and 4 are designated by the same reference number) shows a so-called "vaporization" cooling box 77 whose construction corresponds in a general way to that of box 60 of FIGS. 3 and 4, with the exception of channel 63 which is transferred to the outside of the enclosure.

More precisely, there is associated with one of the walls of the enclosure (in the present case the one 78 which is disposed at the top in the mounted position of the box on the plating of the blast-furnace, such as shown in FIG. 3), an elongate shell 79 defining with wall 78 an outer channel 80.

A supply duct 62 opens tangentially into enclosure 61, for example in accordance with the configuration of FIG. 1 or in accordance with any other configuration, whereas a discharge duct 71 leaves from channel 80. Just as in the preceding embodiment, vanes 68 are provided for causing the liquid to pass through a hole 66 communicating enclosure 61 with channel 80.

Another hole 81 is provided for connecting the discharge chamber 70 with channel 80.

During operation, the vapor bubbles which form particularly in contact with the wall of nose 69, the most exposed to the heat, are torn away as fast as they are created and carried by the rotating liquid mass into enclosure 61.

Considering the gravitational field which reigns within the liquid means, the vapor bubbles are brought to the center of enclosure 61 where they pass into channel 80. Since the liquid is in continuous circulation within the enclosure, there cannot be formed, along the internal face of the walls, particularly in the nose, a vapor veil preventing heat exchanges neither a vapor plug stopping circulation of the water.

Figure 6:
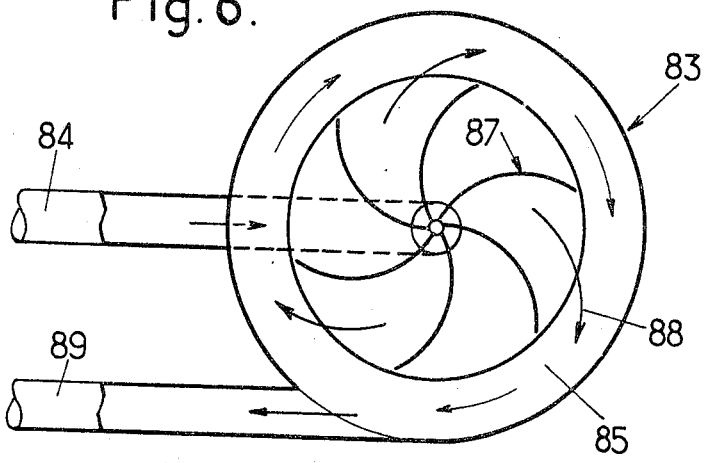
FIG. 6 shows schematically yet another embodiment of a heat exchange device in accordance with the invention.

The cooling box 83 shown in FIG. 6 is designed, contrary to the preceding ones, with a central inlet and a tangential discharge.

A supply duct 84 opens into the center of an enclosure 85 cylindrical in revolution, the liquid penetrating perpendicularly to the circular face 86 of the enclosure.

Deflecting means 87, formed for example like those 68 of FIGS. 3 to 6, impart to the liquid a tangential components so that it is set in rotation and describes a spiral path from the inside to the outside of the enclosure (arrow 88).

A discharge duct 89 extends tangentially and recovers the heated liquid.

Figure 7:
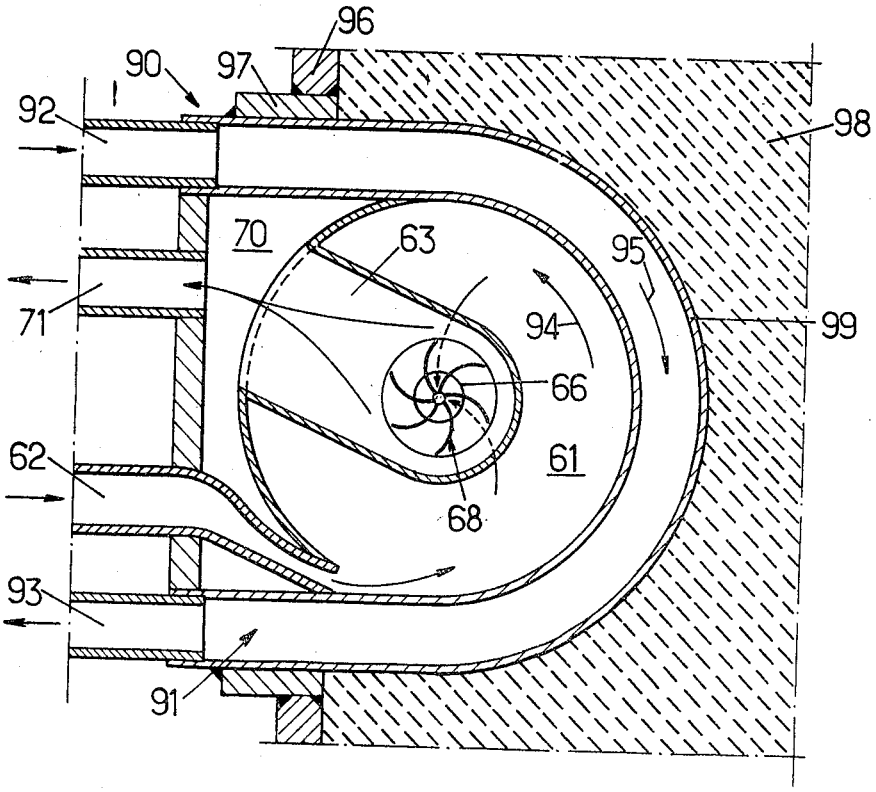
FIG. 7 shows schematically yet another embodiment of a heat exchange device in accordance with the invention.

FIG. 7 shows yet another embodiment of a cooling box in accordance with the invention. Box 90 of FIG. 7 is designed from plate 60 of FIGS. 3 and 4 all the elements of which it employs (the same reference numbers have been kept in FIG. 7).

There is however added a second enclosure 91 which is simply formed by a tubular duct bent in a semi-circle so as to assume the rounded shape of nose 69 of plate 60 of FIG. 3. Tubular duct 91 is connected to the outside hydraulic network by means of supply 92 and discharges 93 ducts.

It will be noted that, in enclosure 61 and in duct 91, the flow directions for the liquid are opposite (respectively arrows 94 and 95).

The result is that in the vicinity of discharge duct 93, where the liquid already heated by its travel through duct 91 is less efficient, beneficial cooling is provided by the cold liquid arriving through duct 62 and emerging into enclosure 61. And conversely in the region of ducts 71 and 92. It is thus possible to obtain better distribution of the cooling of the refractory and, in a general way, improved efficiency.

It will be noted that in FIG. 7, cooling bow 91 has been shown in an operational position, i.e., as has already been explained moreover above, the plate extends practically perpendicularly to the plating 96 of the blast-furnace to which it is fixed in an appropriate way by means of an intermediate shoe 97 and it penetrates into the refractory 98, its nose 99 being turned towards the hot regions of the blast-furnace.

Figure 9:
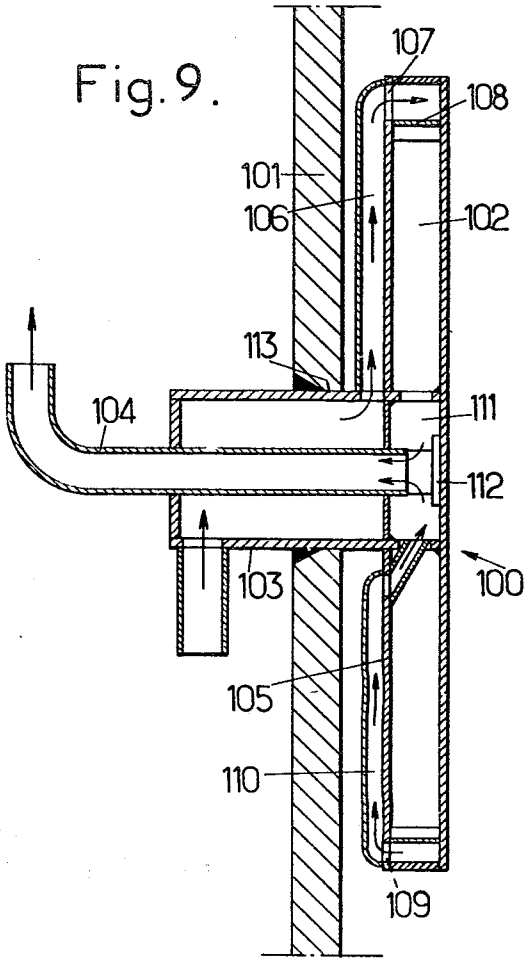
FIG. 9 is a sectional view along line IX—IX of the cooling plate of FIG. 8.
Figure 8:
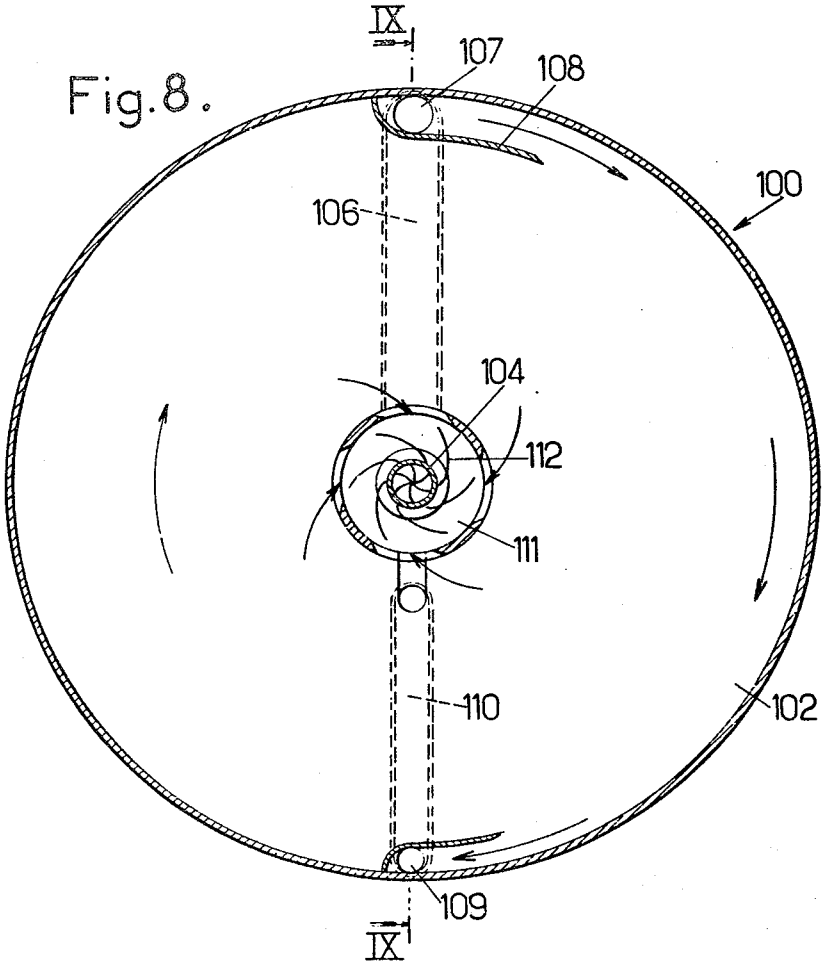
FIG. 8 is a side sectional view of a cooling plate constructed in accordance with the invention.

FIGS. 8 and 9 show a cooling plate 100, for inserting (as has already been indicated above) between the plating 101 of a blast-furnace and the refractory wall (not shown).

Cooling plate 100 has an enclosure 102 cylindrical in revolution, a supply duct 103 for the cooling liquid and a discharge duct 104 for this liquid.

The two ducts 103 and 104 extend, at least in a zone adjacent the cooling plate, substantially perpendicularly to that one 105 of the walls of the enclosure which is turned towards plating 101. Furthermore, the two ducts 103 and 104 are coaxial, duct 104 being inside duct 103, which surrounds it.

By way of example, the arrangement for the cooling plate may be the following.

Supply duct 103 communicates with a channel 106, provided on the outer face of said wall 105 of the enclosure, which opens into enclosure 102 at the periphery thereof through a port 107. A deflecting wall 108 is provided in front of port 107 to deflect the liquid flow so that it gushes tangentially into the enclosure.

Diametrically opposite port 107 is an outlet port 109 by means of which enclosure 102 communicates with a channel 110 (also situated outside wall 105 for example) ending in a central chamber 111 of the enclosure. This central chamber communicates with the rest of the enclosure through apertures 112. In chamber 111 are also disposed deflecting vanes 112 situated opposite the port through which discharge duct 104 opens into said chamber 111.

For fixing cooling plate 100 in the blast-furnace, a hole 113 with a diameter corresponding substantially to the outer diameter of supply duct 103 is bored in plating 101; duct 103 introduced into hole 113 is welded to the plating. Cooling plate 100 is thus securely fixed to the plating solely by its central region, represented by duct 103 serving as a fixing sleeve.

Whatever the deformations which the cooling plate may undergo through the action of the heat, it will be able to freely expand without it being the seat of destructive stresses as was the case with the prior cooling plates presenting a plurality of fixing zones.

Of course, it will be understood that the arrangements which have just been described and combining the supply and discharge means for the cooling liquid with the fixing means are not dependent on the particular configuration of the enclosure shown in FIGS. 8 and 9, and which has only been given by way of example, and that they may just as readily be associated with other enclosure configurations, such as those previously described.

FIG. 11 shows an arrangement combining cooling plates 100, such as those which have just been described, disposed in a staggered arrangement and cooling boxes **100*a*** disposed in the free sectors between the plates.

Thus deep cooling of the refractory, provided by the boxes, may be combined with surface cooling, intended to protect the plating, created by the plates.

FIG. 10 shows a cooling plate 114 which is a variation of the cooling plate 100 of FIGS. 6 and 7.

Plate 114 comprises an axial annular chamber 115 surrounding an axial cylindrical cavity 116 open at both its ends.

Annular chamber 115 is subdivided into two semi-cylindrical half chambers 117 and 118 in which emerge respectively the supply 119 and discharge 120 ducts for the cooling liquid.

For the rest, the cooling plate may be arranged in a substantially identical way to plate 100 of FIGS. 6 and 7 or be constructed in accordance with one or other of the preceding examples.

Plate 114 as a whole is formed so that the axial cavity 116 has a sufficient transverse dimension for a cooling box 121 (preferably, but not exclusively, a cooling box constructed in accordance with the arrangements described in the U.S. Pat. No. 4,210,101 to the applicant).

It is thus possible to form cooling plate+box assemblies which provide, in the same zone of the blast-furnace, cooling of the refractory wall (deep cooling) and cooling between the plating and the refractory wall (surface cooling or thermal screen effect).

FIG. 12 shows the combination of such cooling assemblies (plate 114+box 121) disposed in a staggered arrangement with cooling boxes 122 alone (which may also be preferably, but not exclusively, of the type described in the U.S. Pat. No. 4,210,101 to the applicant) disposed in the sectors left free (arrangement at the corners of a hexagon circumscribed on plates 114).

It is thus possible to create a veritable thermal barriers, whose action extends not only in depth in the refractory but on the surface and which, through the arrangement of the cooling boxes, provides good anchorage for the refractory.

I claim:

1. A heat exchanger comprising: a body having an inner chamber for the circulation of heat-transfer fluid, said chamber being shaped substantially as a chamber of revolution defined by first and second end walls and a curved peripheral wall extending therebetween, said first and second end walls being spaced from one another such that said chamber is substantially flat in shape, at least the first end wall being a heat-transfer wall; a supply port and a discharge port for the heat-transfer fluid, the ports being spaced-apart radially, the supply port being arranged and positioned to supply the heat-transfer fluid tangentially into the chamber and the discharge port being arranged and positioned to discharge the heat-transfer fluid tangentially from the chamber, so that, in use, the fluid flows between the ports in a spiral path over the inner surface of the first end wall, the chamber being free of internal obstacles to such flow.

2. A heat exchanger according to claim 1, in which one port opens tangentially into the body adjacent the curved wall, the other port is adjacent the center of the first end wall, and a deflecting member is provided adjacent the supply port for deflecting the fluid to flow tangentially into the body.

3. A heat exchanger according to claim 2, in which said fluid deflecting member is a curved vane.

4. A heat exchanger according to claim 1, in which the supply port and the discharge port are respectively adjacent the periphery and the center of the first end wall.

5. A heat exchanger according to claim 1, in which both ports are spaced from the axis of the body and the ratio of the areas of the ports is the inverse of the ratio of their radial distances from the axis.

6. A heat exchanger according to claim 1, including means for tangential injection of the liquid to the supply port located in the vicinity of the periphery thereof and means for the tangential discharge of the liquid from the discharge port situated at the center of the enclosure, wherein the tangential discharge means comprise at least one assembly of deflecting means situated in the center of the enclosure and a duct opening into a face of the enclosure opposite said deflecting means.

7. A heat exchanger according to claim 6, in which the discharge duct extends radially from the center of the enclosure to the periphery of the enclosure.

8. A heat exchanger according to claim 7, in which the radial discharge duct is inside the enclosure and extends substantially at the same distance from two lateral walls of the enclosure and wherein there are provided two assemblies of deflecting means, these two assemblies being situated on each side of said duct.

9. A heat exchanger according to claim 8, in which the radial discharge duct is flared outwardly so as to offer minimum resistance to the rotating liquid in the enclosure.

10. A heat exchanger according to claim 7, in which the radial discharge duct opens into a transit chamber, outside the enclosure and comprising a water outlet port.

11. A heat exchanger according to claim 7, in which the radial duct is situated in the upper part of the enclosure and preferably outwardly thereof.

12. A heat exchanger according to claim 1, including a tangential injection means communicating with the supply port and a tangential discharge means communicating with the discharge port, the tangential discharge means comprising a duct opening tangentially into the enclosure, at the periphery thereof, the port of said duct being diametrically opposite the port of the tangential injection means.

13. A heat exchanger according to claim 1, including a tangential injection means communicating with the supply port and a tangential discharge means communicating with the discharge port, the tangential injection means opening into the central part of the enclosure and the tangential discharge means being situated at the periphery of the enclosure, the tangential injection means comprising at least one supply duct for the liquid opening into at least one face of the enclosure and substantially in the center of said face and at least one assembly of deflecting means situated opposite the port of said duct, so as to impart a tangential component of force on the liquid emerging into the enclosure.

14. A heat exchanger according to claim 6, in which the tangential injection means and the tangential discharge means comprise connection means situated side by side and connected to the enclosure through ducts which extend between the two planes containing the two substantially parallel faces of the enclosure, whereby the heat exchanger is able to be mounted on the wall of the blast-furnace perpendicularly thereto, in the manner of a cooling box.

15. A heat exchanger according to claim 6, in which there is further provided a second enclosure covering at least the front part of the first enclosure and wherein there exists no communication for the cooling liquid between the first and second enclosure.

16. A heat exchanger according to claim 6, the injection and discharge means comprising respectively a liquid supply duct and a liquid discharge duct, in which the two ducts extend approximately perpendicularly to one of the walls of the enclosure, at least in the vicinity of said wall, substantially from the central zone of said wall, wherein the two ducts are concentric at least in the vicinity of said wall, and wherein means for securing the device to the plating of the blast-furnace are provided comprise, on the one hand, that one of said ducts which is outside the other and, on the other hand, an orifice provided in the plating and adapted to receive said outer duct, securing means being used to secure the outer duct to the edge of the orifice or to a zone of the plating surrounding the orifice.

17. A heat exchanger according to claim 6, in which there is provided an axial cavity open at both ends, the enclosure surrounding the cavity and the supply and discharge ducts surrounding at least partially the cavity, the transverse dimensions of the cavity being sufficient for it to be possible to introduce therein an elongate and cylindrical cooling device.

* * * * *